US005701775A

United States Patent [19]

Sivilotti et al.

[11] Patent Number: 5,701,775

[45] Date of Patent: Dec. 30, 1997

[54] PROCESS AND APPARATUS FOR APPLYING AND REMOVING LIQUID COOLANT TO CONTROL TEMPERATURE OF CONTINUOUSLY MOVING METAL STRIP

[75] Inventors: Olivo Giuseppe Sivilotti, Kingston, Canada; Gino Luigi Leone, Russellville, Ky.; James Gordon Sutherland, Kingston, Canada; Herbert James Thorburn, Kingston, Canada; Bruno Crosato, Kingston, Canada

[73] Assignee: Alcan International Limited, Montreal, Canada

[21] Appl. No.: 125,343

[22] Filed: Sep. 22, 1993

Related U.S. Application Data

[63] Continuation of Ser. No. 840,448, Feb. 24, 1992, abandoned.

[51] Int. Cl.[6] ..... B21B 27/06; B21B 9/00

[52] U.S. Cl. ..... 72/201; 72/38

[58] Field of Search ..... 72/13, 38, 40, 72/43, 201; 148/643, 644, 654, 696, 698; 266/46, 85, 87, 134, 259

[56] References Cited

U.S. PATENT DOCUMENTS

| | | | |
|---|---|---|---|
| 1,931,912 | 10/1933 | Whitzel | 72/43 |
| 2,330,469 | 9/1943 | Byus et al. | 72/38 |
| 3,192,752 | 7/1965 | Dowd et al. . | |
| 3,200,629 | 8/1965 | James et al. | 72/201 |
| 4,392,367 | 7/1983 | Bald | 72/13 |
| 4,403,492 | 9/1983 | Hope | 72/201 |
| 4,440,584 | 4/1984 | Takeshige et al. | 72/201 |
| 4,477,287 | 10/1984 | Kush et al. | 72/39 |
| 4,551,878 | 11/1985 | Turley et al. | 72/163 |
| 4,570,453 | 2/1986 | Kamio et al. | 72/201 |
| 4,645,185 | 2/1987 | Sabatini | 72/201 |
| 4,844,830 | 7/1989 | Budd et al. | 252/65 R |
| 4,932,232 | 6/1990 | Ballyns et al. | 72/201 |
| 5,186,018 | 2/1993 | van Ditzhuijzen et al. | 72/201 |

FOREIGN PATENT DOCUMENTS

| | | | |
|---|---|---|---|
| 898291 | 5/1984 | Belgium . | |
| 3146657 | 6/1983 | Germany | 72/201 |
| 3309173 | 9/1984 | Germany | 72/201 |
| 0291024 | 6/1991 | Germany | 72/201 |

(List continued on next page.)

OTHER PUBLICATIONS

International Search Report, International Application No. PCT/CA93/00054.

F.C. Kohring, "Waterwall Water-Cooling Systems," AISE Year Book, 1985, pp. 253–259.

S.-J. Chen et al., "Spray and Jet Cooling in Steel Rolling," HTD-vol. 162, Heat Transfer in Metals and Containerless Processing and Manufacturing ASME 1991, pp. 1–11.

J. Filipovic et al., "Thermal Behavior of a Moving Steel Strip Cooled by an Array of Planar Water Jets," HTD-vol. 162, Heat Transfer in Metals and Containerless Processing and Manufacturing, ASME 1991, pp. 13–23.

C. Devadas et al., "Heat transfer during hot rolling of steel strip," Ironmaking and Steelmaking, vol. 13, No. 6, (1986), pp. 311–321.

*Primary Examiner*—Lowell A. Larson
*Assistant Examiner*—Rodney Butler
*Attorney, Agent, or Firm*—Cooper & Dunham LLP

[57] ABSTRACT

Cooling of metal strip in a single or multistand cold rolling line by applying coolant liquid only to the lower surface of the strip, and removing the liquid therefrom, after each, or between successive roll stands. The liquid is delivered, at each cooling locality, at low pressure through a plurality of slots each extending transversely beneath and across the full width of the strip, the slots being spaced apart along the path of the strip and generally being oriented to discharge the coolant liquid toward the strip lower surface at an angle of greater than 90° to the direction of strip advance. Coolant removal is effected by directing one or more liquid knives against the strip lower surface between the plurality of slots and the next downstream roll stand in the line, at a location at which the strip is trained around a hold-down roll.

51 Claims, 6 Drawing Sheets

FOREIGN PATENT DOCUMENTS

| | | | |
|---|---|---|---|
| 0054208 | 4/1980 | Japan | 72/201 |
| 0156824 | 9/1982 | Japan | 72/13 |
| 0215213 | 12/1983 | Japan | 72/201 |
| 0020615 | 1/1986 | Japan | 72/201 |
| 0264212 | 11/1988 | Japan | 72/44 |
| 1026351 | 12/1987 | U.S.S.R. | 72/201 |
| 2111885 | 7/1983 | United Kingdom . | |

PROCESS AND APPARATUS FOR APPLYING AND REMOVING LIQUID COOLANT TO CONTROL TEMPERATURE OF CONTINUOUSLY MOVING METAL STRIP

This is a Continuation of application Ser. No. 840,448, filed Feb. 24, 1992, now abandoned.

BACKGROUND OF THE INVENTION

This invention relates to processes and apparatus for applying liquid coolant to, and removing the coolant from, metal strip advancing in a continuous line. In a particular sense, the invention is directed to cooling of metal strip in single stand and multistand cold rolling mills. Still more particularly, the invention is concerned with processes and apparatus for water cooling of water-stainable metal strip, such as aluminum strip, during cold rolling of the strip in single stand and multistand mills. Detailed reference will be made herein, for purposes of illustration, to the multistand cold rolling mill application.

In the cold rolling of sheet metal such as aluminum strip (the term "aluminum" being used herein to refer to aluminum-based alloys as well as pure aluminum metal), the strip is reduced in thickness by cold working in one or a tandem succession of roll stands each typically including upper and lower work rolls (between which the strip passes) and upper and lower backup rolls respectively above and below (and in contact with) the upper and lower work rolls. The strip to be reduced is paid out from a coil at the upstream end of the cold rolling line, and after passage through the roll stand or stands, is rewound into a coil at the downstream end of the line, the cold-rolling operation being essentially continuous.

Unavoidably, the cold working of the strip as it passes through the nip of each roll stand is accompanied by some elevation of strip temperature. In a single-stand mill, this temperature rise is usually not troublesome provided the strip enters the mill near room temperature. In a multistand tandem mill, however, the increases in strip temperature at the several roll stands are cumulative, with the result that the exit temperature of the strip from the mill may exceed acceptable limits, even with entry at room temperature. For example, computer model analysis of a three-stand mill indicates that the strip exit temperature can approach a value as high as 300° C., depending primarily on the particular alloy being rolled, the extent of the reductions to which it is subjected in the mill, and the rolling conditions. On the other hand, considerations related to process reliability, such as the avoidance of strip breaks, and metallurgical and mechanical considerations related to product performance, require that the exit or coiling temperature of cold-rolled aluminum strip be kept usually between 100° and 180° C., depending on the product, a typical limiting value being around 150° C. Moreover, in the case of some products, it would be highly advantageous to control the coiling temperature of cold-rolled strip within some predetermined range for maximum efficiency and benefit in subsequent process steps. At the time this invention was made, it was not possible to realize this control because usually the roll stands were flooded with coolant, so that the exit temperature depended on the history of the coil, and the rolling conditions. Thus, there was a clear need for controlled cooling of the metal strip between successive roll stands of a multistand tandem cold rolling mill.

Controlled cooling can also be advantageous at the entry of a single stand cold rolling mill. Coils coming from the hot rolling line or from heat treatment, without time for sufficient natural cooling, can be rolled without the exit temperature exceeding acceptable limits. Similarly, it makes possible a back-to-back pass schedule (i.e., a coil rolled, and then immediately re-rolled). Considerable advantage is thereby gained from reduced handling and storing of coils, shortened fabrication time and reduced in process inventory.

At the same time, as the strip is cooled, it is important that the cooling operation not adversely affect other aspects of product quality. One such aspect is control of thickness and flatness, which may be upset if the relatively thin-gauge strip being cold rolled is deflected by the force of high pressure jets of coolant fluid. Again, while water is a preferred coolant from the standpoint of cost and effectiveness, the presence of water may impair the performance of rolling lubricant at the roll stands and, if the strip is aluminum or other water-stainable metal, residual water in the rewound coil may cause unacceptable surface staining.

SUMMARY OF THE INVENTION

The present invention in a first aspect broadly contemplates the provision, in procedure wherein metal strip is advanced continuously longitudinally along a generally horizontal path with opposed major surfaces of the strip respectively facing upwardly and downwardly, of a process for cooling the strip, comprising the steps of delivering coolant liquid into contact with only the downwardly facing surface of the advancing strip by discharging the coolant liquid upwardly, onto the downwardly facing strip surface, through a plurality of upwardly opening slots disposed below the strip in spaced relation thereto, the slots being spaced apart along the path and each extending, transversely of the path, across substantially the entire width of the strip, while preventing the discharged coolant liquid from coming into contact with the upwardly facing surface of the strip, and, downstream of the plurality of slots in the direction of strip advance, removing coolant liquid from the downwardly facing strip surface.

In this process, all the slots are preferably oriented to direct the coolant liquid toward the strip at an angle of at least about 90° to the direction of advance of the strip in the path. Very preferably, most or all of the slots are oriented to direct the coolant liquid toward the strip at an angle greater than 90° to the direction of advance of the strip in the path, although that one or more of the slots which are furthest upstream (with reference to the strip path) may be oriented to direct the coolant liquid toward the strip at an angle of about 90° to the direction of strip advance, to limit the upstream extent of coolant delivery, as may be desired, for instance, to prevent the coolant from reaching a roll stand disposed upstream of the array of slots.

As a particular feature of the invention, the coolant liquid (which is conveniently or preferably water) is supplied to the slots at a pressure such that it impinges on the strip from each slot as a continuous curtain of water across substantially the full width of the strip without substantially upwardly deflecting the strip. In accordance with additional preferred or particular features of the invention, the slots are each between about 0.2 and about 5.0 mm wide, preferably between 0.5 and 2.0 mm wide; the spacing between adjacent slots, in the direction of strip advance, is between about 50 and about 500 mm, preferably between 100 and 150 mm; the slots are all supplied with water from a constant head standpipe, at a pressure head of less than 10 m (preferably less than 3 m, most preferably less than 1 m); and the slots can be shut off individually for precise control of cooling conditions, i.e., so that less than all the slots are discharging water.

It will be understood that the coolant liquid is thus delivered to the continuously advancing strip, in the process of the invention, in a plurality of transverse liquid curtains directed upwardly against the undersurface of the strip at oblique angles counter to the direction of strip advance, the curtains being disposed in tandem succession along the strip path. This cooling arrangement is found fully effective to achieve desired reduction of strip temperature for such purposes as interstand cooling in a multistand tandem cold rolling mill, without upwardly deflecting the strip to any extent that would interfere with control of strip profile and flatness. The direction of the liquid curtains, obliquely counter to the direction of longitudinal strip advance, provides a higher relative velocity between coolant and strip (hence, better heat transfer) than if the curtains were normal to the strip or angled obliquely toward the strip motion direction, imposes a lower deflecting load on the strip than if the curtains were normal thereto, and also minimizes interference of the liquid curtains with discharge of coolant through adjacent slots. Moreover, the application of water (as the coolant liquid) in this manner affords or readily permits avoidance of deleterious presence of residual water on the strip surfaces.

Prevention of water carry-over to the strip upper surface is largely a consequence of the configuration of the water curtains themselves, since these low-pressure continuous curtains exhibit little lateral divergence beyond the side edges of the moving strip. If the slots extend outwardly of the strip side edges, their extremities may be occluded or the water curtains deflected as by shutters to limit the curtain dimensions in accordance with the strip width. Confinement of the region of coolant application (i.e., the locality of the array of slots) below the strip path, using suitable shielding structures, effectively completes the prevention of carry-over of water to the strip upper surface.

Thus, in order to avoid residual water that could cause staining problems or interfere with downstream operations such as flatness or thickness measurements or lubrication for the next downstream roll stand, it is only necessary to remove coolant water from the lower surface of the strip. Such removal is greatly aided by gravity, because the wetted strip surface faces downwardly so that much of the applied water falls from it. The orientation of each water curtain, obliquely counter to the direction of strip advance, also tends to push from the strip surface some of the excess water delivered by the adjacent upstream curtain. A stationary barrier below the strip, at the downstream end of the array of slots, arrests any flying water spray thrown off from the moving strip with a substantial longitudinal velocity.

The step of removing residual water remaining on the strip lower surface, at or beyond the downstream end of the array of slots, is advantageously performed by directing a fluid knife against the strip surface. As herein used, the term "fluid knife" refers to a curtain or array of jets of gas and/or liquid, under relatively substantial pressure, impinging against the water-bearing strip surface at an angle obliquely counter to the tangential direction of strip movement at the location of impingement, so as to force the residual water from the surface.

The invention in a second aspect, very preferably employed for performance of the removal step in the cooling process just described, contemplates the provision of a process for removing residual coolant liquid (e.g. water) from a downwardly facing surface of a continuously longitudinally advancing metal strip by directing a liquid knife against the downwardly facing strip surface, at an angle greater than 90° to the direction of strip advance, downstream of the plurality of slots, while training the strip around a hold-down roll in contact with the upwardly facing strip surface at a location such that the liquid knife impinges against the downwardly facing strip surface at a point at which the upwardly facing strip surface engages the hold-down roll.

In one embodiment of the invention in this aspect, the liquid knife is a knife of the coolant liquid, and the coolant-removing process of the invention in this aspect further includes the step of directing a second liquid knife, of a liquid immiscible with the coolant liquid, against the downwardly facing strip surface at a point, downstream of the point of impingement of the first-mentioned liquid knife, at which the upwardly-facing strip surface still engages the hold-down roll. In a second embodiment, only one liquid knife is employed, of a liquid immiscible with the coolant liquid. For example, in either embodiment, where the coolant liquid is water, the immiscible liquid may be kerosene or oil, e.g. rolling lubricant. It is found that in either embodiment, the residual coolant liquid on the strip surface is sufficiently reduced both to prevent interference with downstream operations and to avoid staining of the strip surfaces.

Still more complete removal of coolant may be achieved by training the strip, downstream of the hold-down roll and the liquid knife or knives, over a guide roll that engages the downwardly-facing strip surface. The guide roll removes liquid from the latter surface by a squeegee effect.

While the cooling and coolant-removal processes of the invention are broadly applicable to any in-line metal strip cooling operation, for example incident to annealing, the invention in a further and particularly important aspect contemplates the incorporation of these processes in multistand tandem cold rolling of metal strip, to provide interstand cooling of the strip. In this aspect, the strip continuously advancing through the cold rolling line is cooled, at a cooling locality between successive tandem roll stands, by directing the above-described curtains of water against only the downwardly-facing surface of the strip from a plurality of transversely extending slots disposed in tandem at that locality beneath the strip, and removing residual coolant liquid from the downwardly-facing strip surface between the plurality of slots and the next downstream roll stand, preferably by the removal process of the invention employing one or more liquid knives impinging against the strip surface at a point or points at which the strip upper surface is engaged by a hold-down roll. The cooling and removal of coolant are effective to maintain the strip temperature at an acceptably low value for rewind coiling and to reduce residual coolant as desired for avoidance of staining in the rewind coil, even when the coolant is water and the strip is aluminum. Where the cold-rolling line includes more than two stands, the cooling and removing steps may be performed at each of a plurality of cooling localities respectively disposed between successive roll stands. Where the cold rolling line includes only one roll stand, the cooling and removing steps may be performed at a cooling locality disposed between the coil pay-off stand and the roll stand in a locality where the strip is advanced along a generally horizontal path.

An additional advantage of the invention is that satisfactory coolant delivery is achieved without requiring inconveniently close tolerances in the manufacture of the equipment used.

In a further aspect, the invention contemplates the provision of apparatus for performing the cooling and liquid-removal operations described above. Such apparatus broadly comprises the combination, with means for advancing metal strip continuously in a longitudinal direction along a defined substantially horizontal path, of means for delivering coolant liquid into contact with only the downwardly facing surface of the advancing strip by discharging the coolant liquid upwardly, onto the downwardly facing surface of the strip, through a plurality of upwardly opening slots disposed below the strip in spaced relation thereto, the slots being spaced apart along the path and each extending, transversely of the path, across substantially the entire width of the strip; means for supplying the coolant liquid to the slots; means for preventing the discharged coolant liquid from coming into contact with the upwardly facing surface of the strip; and means for removing coolant liquid from the downwardly facing strip surface downstream of the plurality of slots.

The invention in a more specific sense contemplates the combination of these elements with a single stand mill or in a multistand cold-rolling line including at least two roll stands disposed in tandem along the strip path, wherein the slots and removing means are disposed between the two roll stands.

In yet another aspect, the invention contemplates the provision of apparatus for removing coolant liquid from the downwardly facing surface of a continuously advancing metal strip, comprising means for directing at least one liquid knife against the downwardly facing strip surface, at an angle greater than 90° to the direction of strip advance, downstream of the cooling locality; and a hold-down roll around which the strip is trained in contact with the upwardly facing surface of the strip at a location such that the fluid knife impinges against the downwardly facing strip surface at a point at which the upwardly facing strip surface engages the hold-down roll.

In yet another aspect, the invention contemplates the provision of a closed loop or predictive control system of the amount of strip cooling required, depending on the alloy and rolling conditions prevailing. The control scheme can be on a coil by coil basis or it can be continuous and in-line by feeding a signal from an in-line temperature sensor to the cooling apparatus. The control scheme permits compensation for variations in the conditions and/or properties of the incoming coils and the rolling process that influence the properties of the coils at the exit end of the rolling process (such as composition, entry temperature, degree of work hardening etc.), by controlling the amount of cooling to achieve the target exit temperature that would give consistent desired product properties.

In other words, control of strip cooling is a means to achieve target exit temperature(s) which in turn is a means to obtain consistent and desired product mechanical properties.

Further features and advantages of the invention will be apparent from the detailed description hereinafter set forth, together with the accompanying drawings.

DETAILED DESCRIPTION

The invention will be described as embodied in a process and apparatus for cooling, and removing coolant from, an aluminum strip between successive roll stands of a multistand tandem cold-rolling line (mill) through which the strip is continuously advanced longitudinally for progressive reduction of strip thickness, i.e., at each of the roll stands.

Cold-Rolling Mill

Figure 1:
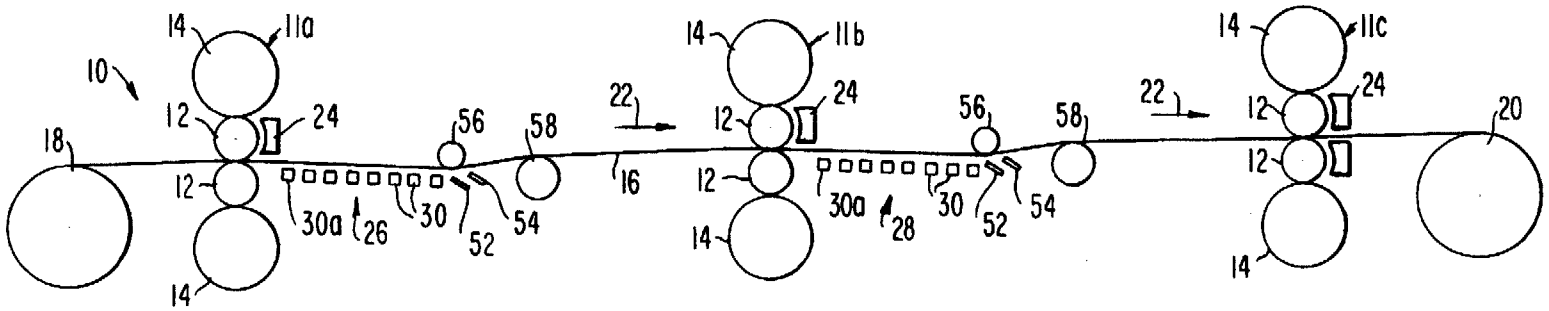
FIG. 1 is a highly simplified and schematic elevational view of a multistand tandem line for cold-rolling metal strip, incorporating an embodiment of the apparatus of the invention and arranged for performance of the process of the invention, in illustrative embodiments.
Figure 3:
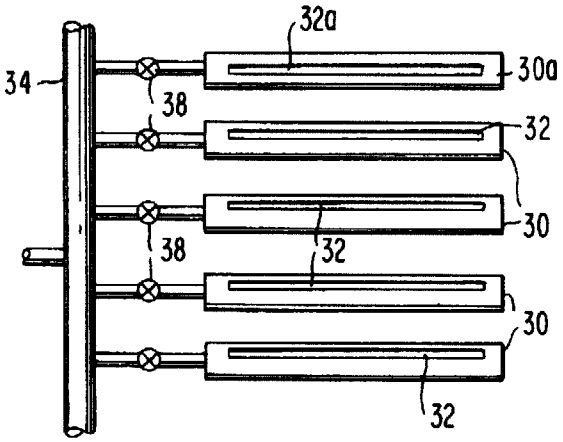
FIG. 3 is a simplified schematic fragmentary plan view of the coolant-supplying system of FIG. 2.
Figure 2:
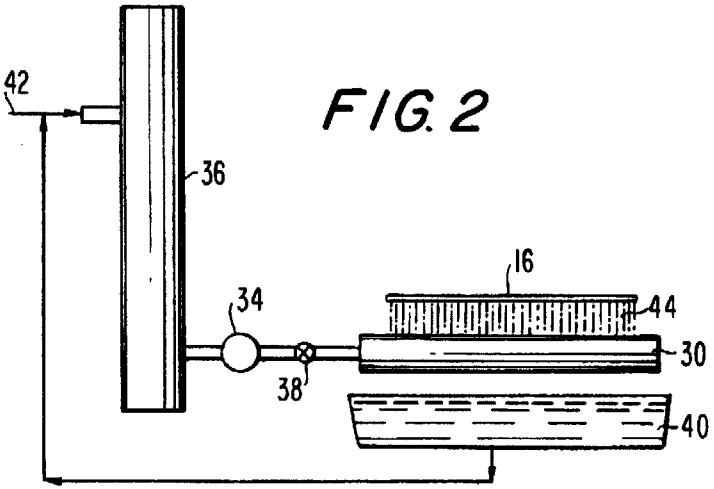
FIG. 2 is a simplified schematic end elevational view of a coolant-supplying system for use in the apparatus of FIG. 1.
Figure 4:
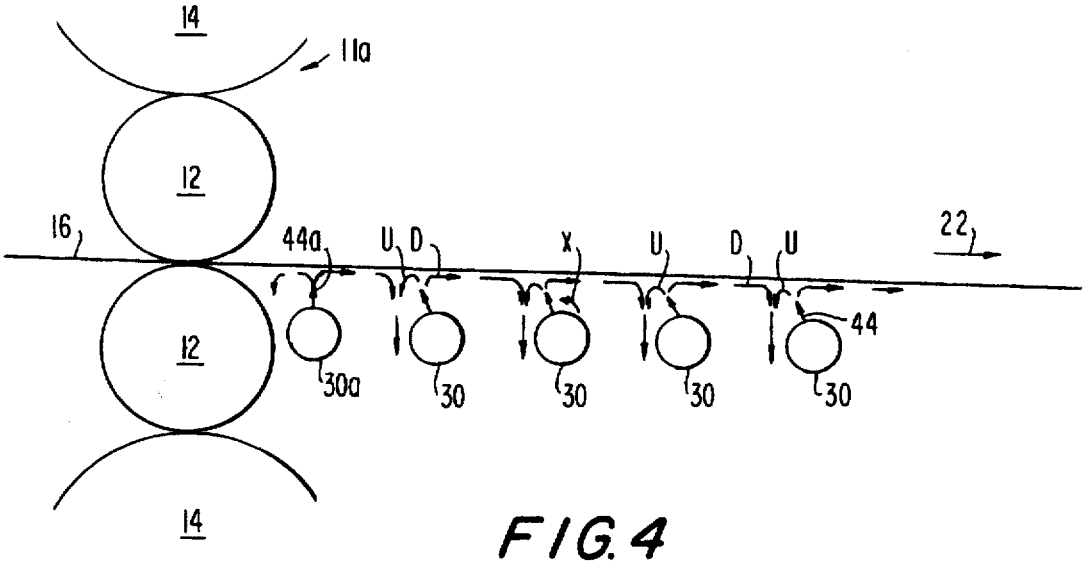
FIG. 4 is an enlarged schematic view of a portion of one of the cooling localities in FIG. 1 illustrating features of coolant liquid flow therein.
Figure 5:
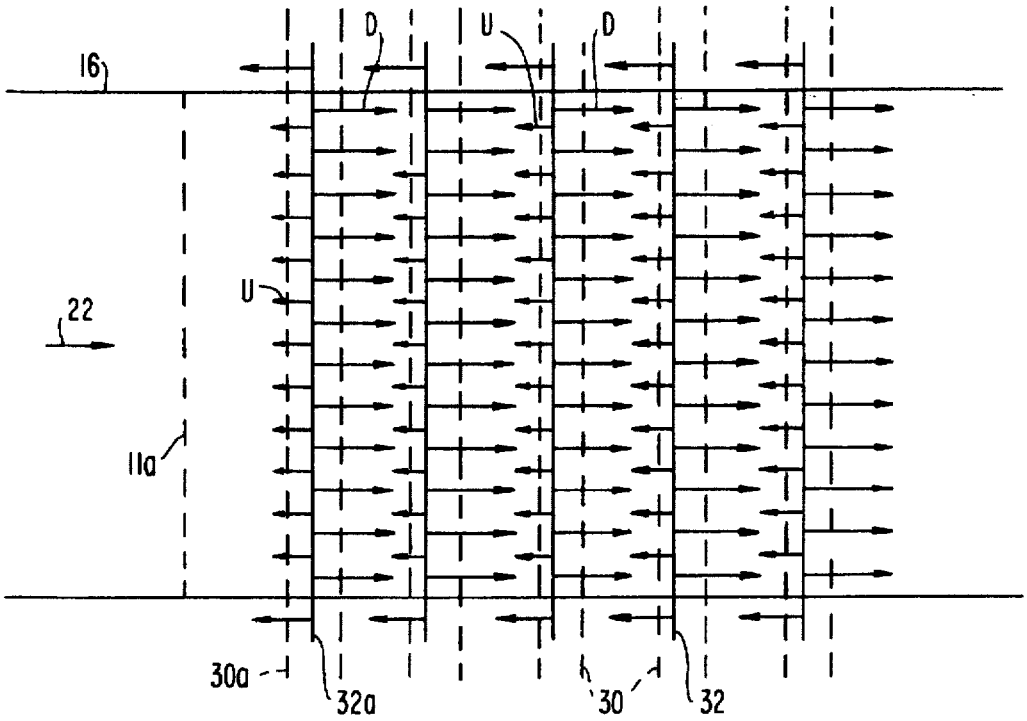
FIG. 5 is a simplified diagrammatic plan view of the cooling locality of FIG. 4, further illustrating coolant liquid flow patterns.

FIG. 1 shows a generally conventional multistand tandem cold-rolling line 10, the arrangement and operation of which are well-known, and accordingly need not be described in detail. The specific line illustrated includes three roll stands 11*a*, 11*b* and 11*c*, each comprising upper and lower work rolls 12 and upper and lower backup rolls 14 respectively above and below (and in contact with) the work rolls. These three roll stands are disposed in spaced, tandem relation to each other along a generally horizontal path of advance of an aluminum strip 16 from a pay-off coil 18 to a rewind coil 20. The strip 16 is continuously longitudinally advanced along this path (with one of its two major surfaces facing upwardly and the other facing downwardly), in the direction indicated by arrows 22, passing in succession through the nips between the work rolls of the three roll stands 11*a*, 11*b* and 11*c* and undergoing reduction in thickness at each roll stand, so that the strip in the rewind coil 20 is substantially thinner in gauge than that in the pay-off coil 18.

Each roll stand is provided with means, indicated schematically at 24, for applying coolant to the rolls. Preferably each such means 24 incorporates coolant containment apparatus (not shown) of the type disclosed in U.S. Pat. No. 5,046,347, the disclosure of which is incorporated herein by this reference. The coolant containment apparatus at each roll stand enables the rolls to be adequately cooled with water while preventing deleterious carry-over of coolant water on the water-stainable surfaces of the aluminum strip 16 downstream of each roll stand in the direction of strip advance. It will be understood that the mill also incorporates other known or conventional features (not shown) for such purposes as strip thickness and flatness control.

During operation of the cold-rolling line 10, heat is generated incident to the cold working of the strip 16 at each of the roll stands. While the means 24 prevent excessive heating of the rolls themselves, the strip temperature is elevated as the strip passes through each roll stand, and unless the strip is subjected to cooling between successive roll stands, these temperature increases have a cumulative effect, so that the temperature of the strip exiting the mill may, for example, approach 300° C., whereas the strip temperature at the rewind coil should typically be not more than about 150° C. Thus, it is desirable to counteract the cumulative temperature increases with interstand cooling of the strip.

The present invention, in the embodiments now to be described, effects interstand cooling of the strip at localities 26 and 28 in the three-stand mill 10 to provide an acceptably low exit or rewind temperature for the cold-rolled strip.

Cooling Apparatus

In accordance with the invention, in its described embodiment and as illustrated in FIGS. 1–8, at each of the interstand cooling localities 26 and 28 respectively defined between roll stands 11*a* and 11*b* and between roll stands 11*b* and 11*c* there are provided a plurality of axially horizontal manifolds 30 (eight such manifolds being shown at each interstand cooling locality in FIG. 1), each having a single, continuous, longitudinal, generally upwardly directed slot 32 extending for most of its length. The manifolds at each cooling locality are disposed in parallel relation to each other below the path of the strip 16 so that the slots 32 extend beneath and transversely of the advancing strip, in spaced-apart tandem relation to each other along the strip path, opening toward the downwardly-facing surface of the strip.

Each of the slots 32 is formed with convergent edges, and has a uniform width of between about 0.2 and about 5.0 mm and most preferably about 2.0 mm and a length at least about equal to the maximum width of strip 16 that may be rolled in the mill 10. The manifolds are so positioned, below the strip path, that the opposite ends of each slot are respectively in register with the locations of the opposed side edges of a strip of such maximum width advancing through the mill. The spacing between adjacent slots, in each interstand cooling locality, is typically or preferably between about 50 and about 500 mm, more preferably about 100 to about 150 mm; also, the slots are conveniently spaced about 50 mm below the downwardly-facing surface of an advancing strip 16.

All of the manifolds 30 at both interstand cooling localities 26 and 28 are connected as by piping 34 to a single, common constant head standpipe 36 (FIG. 2) from which coolant liquid (i.e., water, in the described embodiments of the invention) is delivered to the manifolds at low pressure for discharge through the slots. Each manifold has its own individual valve 38 (FIG. 3) for shutting off and turning on the supply of water to it from the standpipe. Water discharged through the slots, and thereafter falling from the strip 16, is collected beneath the manifolds as indicated diagrammatically (in a highly simplified manner) at 40 in FIG. 2 and returned to the standpipe 36, together with makeup water as indicated at 42, under control of a suitable and e.g. conventional device (not shown) to maintain the requisite constant head of water in the standpipe. In practice, the recirculation of interstand cooling water may be integrated with the collection of water from, and recycling to, the roll stand cooling system and the coolant removal apparatus described below, and (as also explained below) the integrated operation may further involve separation and recovery of oil that is admixed with the water collected from some of these sources.

The pressure of the head in the standpipe forces the water delivered to each manifold 30 outwardly through the slot 32 of the manifold as a continuous upwardly directed curtain 44 of water that impinges against the downwardly facing surface of the strip 16 across at least substantially the full width of the strip. At each of the interstand cooling localities 26 and 28, at least the manifold 30*a* which is furthest upstream in the direction of strip advance (i.e., closest to the immediately upstream roll stand, 11*a* in the case of locality 26) is so oriented that the water curtain 44*a* (FIG. 4) discharged by its slot 32*a* is directed at an angle of substantially 90° to the downwardly facing surface of the strip 16 advancing in the strip path above the manifolds. As FIG. 4 also shows, the other manifolds (downstream of manifold 30*a*) at each interstand cooling locality are so oriented that the water curtains 44 discharged through their respective slots 32 are oriented at an oblique angle $\alpha$ counter to the direction of strip travel at the location of impingement of the curtains with the strip. This oblique angle is not highly critical; typically or preferably, it may be about 110° to about 115° to the direction of strip advance, so that each curtain points upstream at about 20° to about 25° to the vertical.

Figure 6:
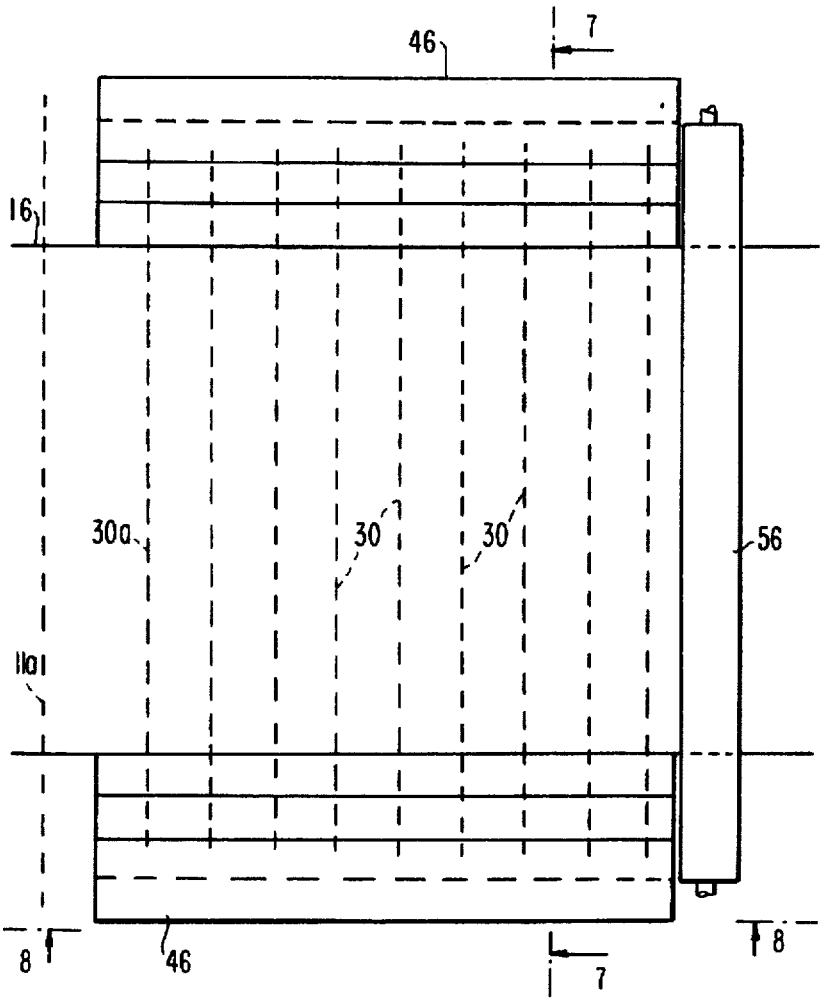
FIG. 6 is a schematic plan view of one of the cooling localities in FIG. 1.
Figure 7:
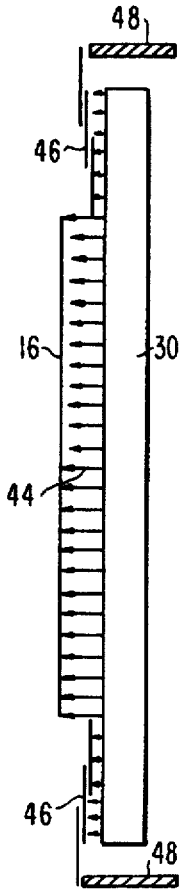
FIG. 7 is a schematic end elevational view of the cooling locality of FIG. 6, taken along line 7—7 of FIG. 6.

Any given cold-rolling mill is usually employed at different times to roll metal strips of various different widths. To adapt the present cooling apparatus to changes in strip width, arrays of overlapping movable shutters 46 (extending lengthwise of the strip path, and movable laterally relatively to the path) are disposed along each side of each of the interstand cooling localities 26 and 28, between the manifolds 30 and the path of the strip 16, as shown in FIGS. 6 and 7, for adjustably deflecting opposite end portions of the curtains 32 in conformity with the width of the strip 16 being rolled in the mill 10. The shutters, supported by suitable structure (not shown) for lateral displacement, are positioned .to cover the end portions of the slots that extend beyond the side edges of the strip being rolled, so as to deflect the discharge of water through those end portions. Alternatively, the effective length of the slots can be adjusted by occluding devices internal or external to the manifolds, so that the water curtains emerge only over a length equal to the strip width. As a result, the position and dimension (transverse to the strip) of the water curtain 44 that impinges on the strip from each slot is so controlled that the curtain is in register with the advancing strip and impinges against substantially the full width of the downwardly-facing strip surface but does not project beyond the strip side edges.

Each interstand cooling locality 26 and 28 is also laterally enclosed by fixed side plates 48 (FIG. 7) extending along the opposite ends of the manifolds 30 below the level of the path of strip advance for confining water, discharged through the slots 32, against lateral escape from the interstand cooling localities beneath the strip 16. In the present apparatus, coolant liquid is applied only to the downwardly facing surface of the strip; no water or other liquid is applied by the apparatus to the strip upper surface. The side plates 48, together with the movable shutters 46, prevent water discharged through slots 32 from coming into contact with the upper surface of the strip. For full control of the dryness of the upper surface of the strip, devices (not shown) such as air blow-offs and cooling boxes, heretofore known and used in cold-rolling mills, may be employed.

Coolant Removal Apparatus

At each interstand cooling locality, downstream of the array of manifolds 30 therein (i.e., between the manifolds and the next downstream roll stand in the path of the strip), a transverse stationary barrier 50 (FIGS. 8–10) is disposed below the strip path to arrest coolant water that has been thrown or fallen from the lower surface of the strip with a significant component of velocity (imparted by the moving strip) in the direction of strip advance. The barrier is arranged to prevent the arrested water from splashing back on the strip. However, the top edge of this barrier must be spaced below the strip path, typically at a stand-off (distance) of about 50 mm, to prevent possibly damaging contact of the strip with the barrier and to avoid problems in the event of a break in the strip. Consequently, a gap remains through which water can pass between the barrier and the strip; and the barrier cannot function to remove residual coolant water carried on the downwardly-facing strip surface.

Figure 8:
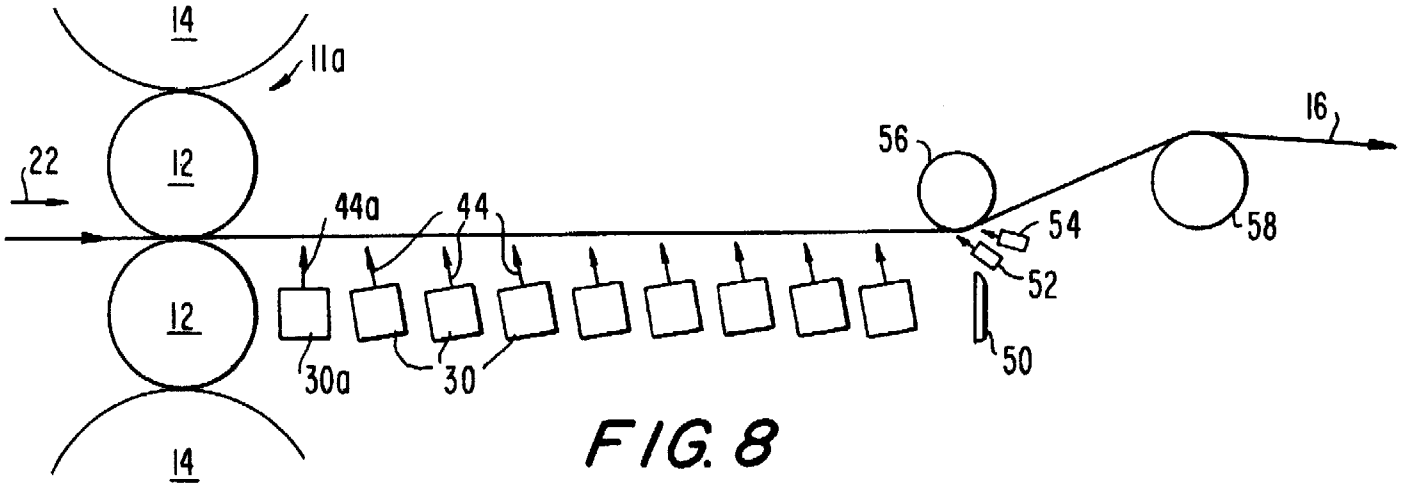
FIG. 8. is a schematic side elevational view, taken as along line 8—8 of FIG. 6, of the cooling locality of FIG. 6 and associated elements including a system in accordance with the invention for removing coolant liquid.
Figure 9:
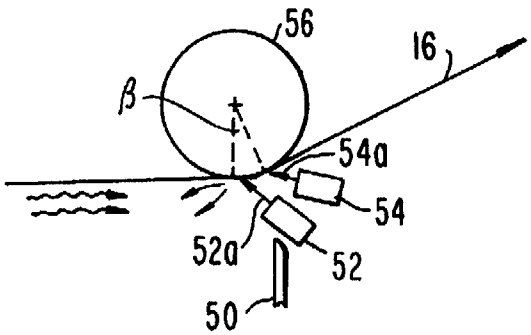
FIG. 9 is an enlarged schematic side elevational view of the coolant removal system of FIG. 8.

The apparatus of the invention, in the embodiment illustrated in FIGS. 1, 8 and 9, includes (at each interstand cooling locality) two liquid knife nozzle arrays 52 and 54 disposed in tandem adjacent the barrier 50, i.e., between the array of manifolds in the interstand cooling locality and the next downstream roll stand in the path of strip advance, providing two liquid hives (respectively designated 52*a* and 54*a*) for acting in succession on the downwardly-facing surface of the advancing strip to remove therefrom residual coolant water (applied to the strip surface by the water curtains) as well as to prevent downstream passage of flying water through the gap between the strip and the barrier 50. This apparatus, at each interstand locality, also includes an axially horizontal hold-down roll 56, disposed immediately above (and extending transversely of) the path of the strip 16 at the location at which the liquid hives 52*a* and 54*a* act against the strip lower surface. The advancing strip is trained around the hold-down roll 56 with its upper surface engaging the hold-down roll through a wrap angle β (FIG. 9), such that throughout angle B the strip is backed up by roll 56.

The liquid knife nozzle arrays deliver a high pressure spray of liquid, constituting a liquid knife, against the downwardly-facing strip surface, across the full width of the strip, along a line of impingement within wrap angle β, i.e., a line at which the strip upper surface engages the hold-down roll. Both liquid knives 52*a* and 54*a* are directed toward the downwardly facing strip surface at angles obliquely counter to the tangential direction of strip advance at their respective lines of impingement, e.g. at angles of about 150° to the tangential direction of strip advance. The two lines of impingement are both so positioned, on the strip surface curving around the hold-down roll, that liquid is deflected therefrom downwardly away from the strip.

As will be appreciated, in each interstand locality, the downwardly facing strip surface (after passing the last of the water curtains delivered by the array of manifolds 30) successively encounters the two liquid knives 52*a* and 54*a*. The first of these liquid hives (52*a*) is a knife of water, acting to intercept the oncoming (forwardly directed) coolant water with sufficient momentum to arrest its advance beyond the barrier as well as to effect removal of some of the residual coolant water carried on the downwardly facing strip surface from the water curtains 44. The second liquid knife (54*a*) is a knife of a liquid which is immiscible with water and which does not stain the strip surfaces; very conveniently, this liquid may be the same oil that is used as a rolling lubricant in the mill. The function of the second knife is to reduce the residual film of water carried on the downwardly facing strip surface sufficiently to prevent interference of the water with downstream operations and to prevent staining of strip surfaces in the rewind coil 20.

The positioning of the water knife should be such that it does not interfere with the coolant water curtains from the manifolds 30 but presents an effective counter-momentum barrier to flying coolant water propelled by the strip. The positioning of the oil knife should be such that the oil knife is not contaminated by water before impingement.

Since the strip is backed up, at its upper surface, by the hold-down roll 56 at the lines of impingement of both liquid knives, the strip is not deflected from its path by the high-pressure liquid knives. Moreover, the axial length of the hold-down roll is selected to be greater than the maximum width of strip to be rolled in the mill, and the end portions of the roll project beyond the side edges of the strip to confine the liquid knife spray outwardly of the strip edges. The curve of the strip in the wrap angle around the hold-down roll facilitates control of the forward extent of spray by adjustment of the angles of impingement of the liquid knives. In addition, because the water-bearing lower surface of the strip is on the outer side of the wrap of the strip around the hold-down roll, water on the strip passing around the hold-down roll is subjected to centrifugal force which can cause significant amounts of water to be thrown off from the strip surface, thereby contributing to coolant removal.

Downstream of the hold-down roll in each interstand locality, and ahead of the next successive roll stand, the strip is trained over a guide roll 58 to direct it properly toward the nip of the next roll stand. This guide roll, engaging the downwardly facing strip surface, exerts a squeegee action thereon to effect still further removal of coolant.

Figure 10:
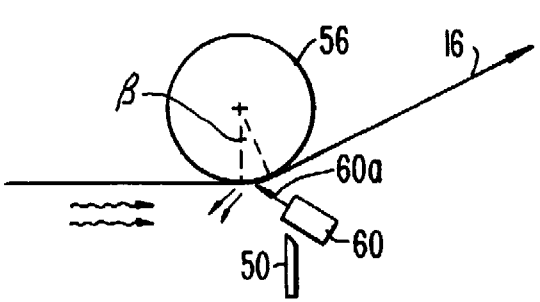
FIG. 10 is a view similar to FIG. 9 of a modified embodiment of the coolant removal system.

In the modified embodiment illustrated in FIG. 10, the two liquid knife nozzle arrays of FIG. 9 are replaced by a single liquid knife nozzle array 60, providing a single liquid knife 60*a* again directed against the downwardly facing strip surface at a line of impingement within the wrap angle β and at an angle of impingement obliquely counter to the tangential direction of strip advance at the line of impingement, the angle and position of impingement being selected for deflection of spray from the liquid knife downwardly away from the strip. The liquid knife 60*a* is a knife of a non-staining liquid immiscible with water, preferably being the rolling oil (as in the case of liquid knife 54*a*), and is delivered at a flow rate and pressure sufficient to perform the functions of both knives 52*a* and 54*a* in the FIG. 9 embodiment. In particular, the flying-coolant containment function of the water knife 52*a* of FIG. 9 is provided, in the FIG. 10 embodiment, by the action of the oil of knife 60*a* that ricochets downwardly off the strip curving around the hold-down roll upstream of the oil knife itself, thereby preventing contamination of the oil jets with water.

The nozzle arrays employed for the liquid knives of each of the FIG. 9 and FIG. 10 embodiments are conveniently arrays of nozzles providing flat jets, disposed in a line (i.e., side by side, extending beneath and transversely of the strip path) to provide full transverse coverage of the strip surface but with no mutual interference of jets before impingement, and supplied by suitable means (not shown) with liquid (water or oil) at appropriate pressures to perform the liquid knife functions described above. In the embodiments of both FIGS. 9 and 10, spray from the liquid knives includes both water and oil; this spray, deflected downwardly from the strip, may be collected in the general coolant catchment system represented at 40 (FIG. 2), the liquid from which is treated to separate the water from the oil for subsequent recycling of both.

Process

The process of the invention, as performed with the above-described apparatus for interstand strip cooling and coolant removal in the mill 10, may now be explained.

When the mill 10 is operating, aluminum strip 16 is advanced continuously longitudinally in succession through the three roll stands 11*a*, 11*b* and 11*c* for progressively reducing the thickness of the strip, along a generally horizontal path in which the strip advances with its opposed major surfaces respectively facing upwardly and downwardly. By the process of the invention, the strip is cooled as it passes through each of the interstand localities 26 and 28 (to counteract the elevation of temperature respectively imparted to the strip at roll stands 11*a* and 11*b*) sufficiently to achieve a desirably low rewind strip temperature at the exit end of the mill.

To this end, at each of the interstand cooling localities, water (as a coolant liquid) is delivered into contact with only the downwardly facing surface of the advancing strip by discharging the coolant liquid upwardly, onto the downwardly facing strip surface, through a plurality of upwardly opening slots 32 disposed below the strip in spaced relation thereto, the slots being spaced apart along the path and each extending, transversely of the path, across substantially the entire width of the strip. Thus, at each cooling locality, the downwardly facing strip surface encounters a tandem succession of upwardly directed water curtains 44 each of which is continuous and uniform in pressure across the strip width. At least the furthest upstream curtain 44*a* (i.e., the curtain closest to the immediately preceding roll stand) may be oriented at about 90° to the direction of strip travel, to avoid interference with the adjacent upstream roll stand, while the remaining curtains in the cooling locality are oriented at a moderate oblique angle counter to the direction of strip travel.

The water is supplied to the slots 32 in both interstand cooling localities from the constant head standpipe 36 at a low pressure, preferably just sufficient to maintain a constant flow of the curtains into contact with the strip surface, so as to avoid any substantial upward deflection of the strip by the applied water. To satisfy these conditions, the head of water supplied to the slots 32 should be less than about 10 m (corresponding to a pressure of 100 kPa gauge at the slots), generally not more than about 3 m (corresponding to 30 kPa gauge, and preferably about 1 m (corresponding to 10 kPa gauge). The water is usually supplied at ambient room temperature, and in any event at a temperature of not more than about 40° C. (preferably not more than about 30° C.), to provide a sufficient strip/water temperature differential for effective cooling.

Control of the extent of cooling is effected by selectively shutting off the flow through one or more of the slots at either or both of the interstand cooling localities, using the valves 38 associated with the individual slot-bearing manifolds 30. To reduce the cooling in a given interstand locality, the slot furthest upstream (32*a*) is shut off first, and then additional slots are shut off (as needed) in succession from the upstream end of the array of slots. The shutting off is by manual means, or more preferably by automatic means responsive to an error signal from a coiling temperature sensor, not shown. It can also be responsive to a precalculated function of the efficiency of the cooling apparatus, related to the entry coil conditions and properties and the rolling conditions, and aimed at maintaining the coiling temperature at a preset target.

In the present cooling process, water is employed as the coolant, notwithstanding its tendency to stain metals such as aluminum (and the consequent stringent requirement for coolant removal), because of its ease of application and also because of the relatively high heat transfer necessary to achieve the desired cooling. Air cannot provide the requisite heat transfer, and the heat transfer attainable with oil is also so much lower than with water that use of oil as the coolant would impose unacceptable limits on strip speed and reductions.

Application of water to only the downwardly-facing surface of the strip facilitates coolant removal, since gravity acts directly to promote removal of the coolant there applied, and since only one strip surface requires substantial coolant-removal treatment. However, with only one side of the strip directly cooled, higher heat transfer is necessary (for a given temperature reduction) than if both sides were cooled. Heat transfer is directly related to the relative velocity between coolant and strip. High-pressure spray jets of water directed obliquely against the strip, counter to the direction of strip advance, could provide a high coolant/strip relative velocity, but if applied to only one strip surface such jets would subject the strip to a significant load tending to deflect the strip out of its path and consequently to interfere with strip thickness and flatness control, at least unless counteracted by costly and complex arrangements for exerting a positive or negative pressure on the strip. High pressure water jets present additional difficulties as well, from the standpoint of ease of control and otherwise; for example, they tend to produce nonuniform water coverage transversely of the strip, and to project substantial amounts of water laterally beyond the strip edges, with resultant exposure of the strip upper surface to water.

In the process of the invention, the strip passes at high velocity over continuous curtains of water moving at a much lower speed. The invention embraces the discovery that such low pressure curtains of water, discharged upwardly through continuous transverse slots extending across the full strip width, and applied only to the lower surface of the strip, provide fully adequate heat transfer to achieve the desired interstand strip cooling in a multistand aluminum cold-rolling mill. The linear slots employed in the process afford full uniformity of strip surface coverage in the transverse direction, and adequate though not wholly uniform coverage in the longitudinal direction (which is less significant than the transverse direction for flatness control). The superior extent and uniformity of surface coverage thus provided by the continuous low-pressure curtains (as compared with high-pressure jet sprays) contributes to effective cooling although the relative velocity of strip and coolant is lower with such curtains than with high-pressure sprays.

Figure 11:
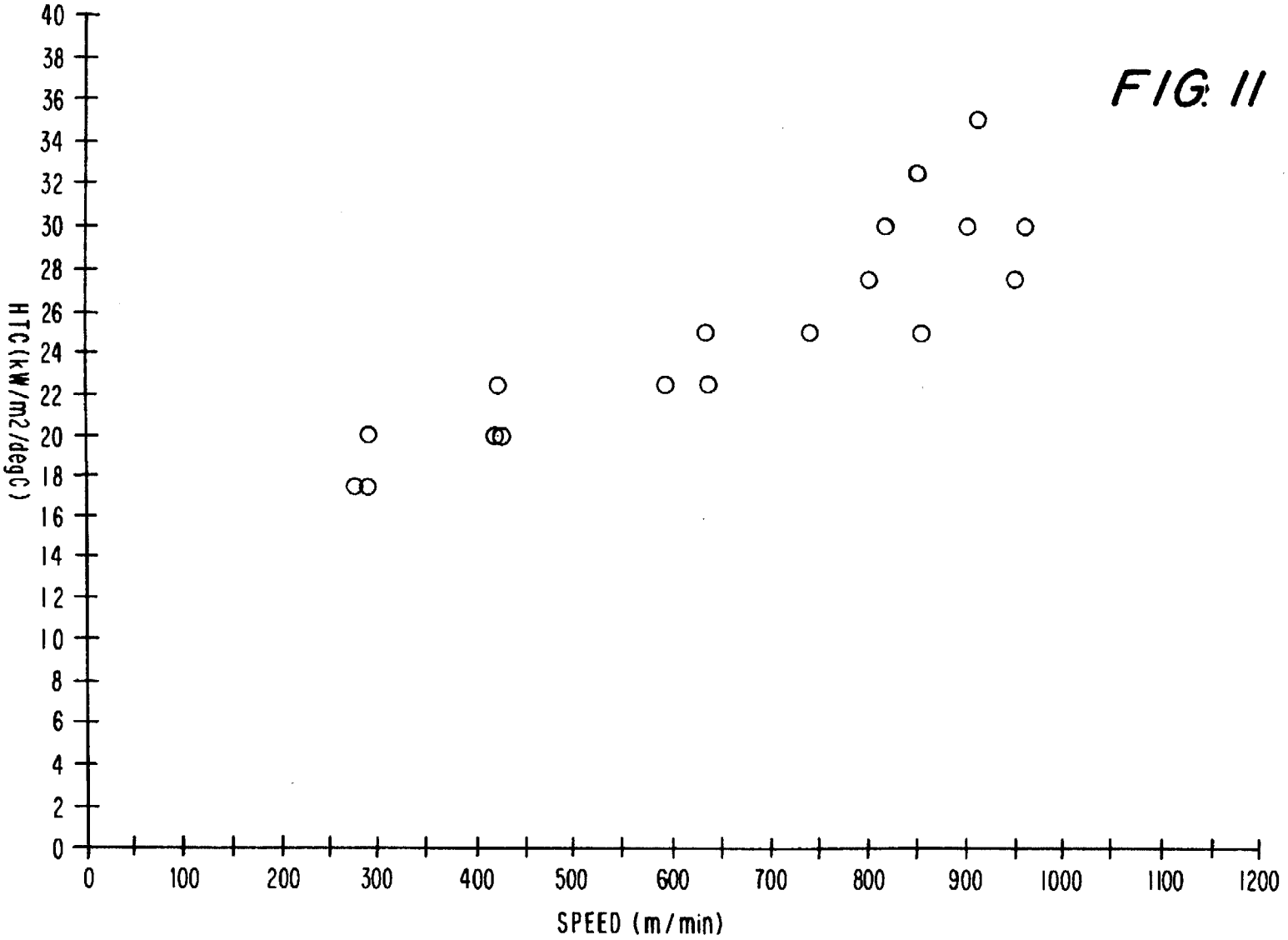
FIG. 11 is a graph relating heat transfer coefficient to strip speed, in cooling with low pressure water curtains.

It is found that in cooling of strip with the low-pressure transverse water curtains, the heat transfer coefficient increases as the strip velocity increases, as shown in FIG. 11. This is beneficial for cooling of strip in a multistand cold rolling line, since strip velocities can be significantly different in successive interstand cooling localities. For a given target temperature, increased heat transfer is required as the strip speed increases. The relationship between heat transfer coefficient and strip velocity in the present process is also advantageous from the standpoint of operating stability, as it makes the cooling almost self-regulating during strip speed variations.

Because the pressure of the curtains is low, in the process of the invention, the problem of coolant forces loading and deflecting the strip is minimal. The angle of the curtains is also not critical for avoidance of strip deflection; hence the angle can be selected in accordance with other considerations such as ease of avoiding interference of coolant water with an adjacent upstream roll stand and optimum draining between curtains. More particularly, as described above, it is advantageous that the curtains (except for the furthest upstream curtains in each interstand cooling locality) be inclined obliquely counter to the direction of strip travel, the angle of such inclination not being highly critical. This orientation of the curtains not only enhances the relative coolant/strip velocity, but in addition, if the curtains are inclined in the direction of strip motion, the flows tend to agglomerate and ultimately to swamp the downstream curtains, while curtains inclined counter to the direction of strip motion tend to cover their own respective longitudinal spaces, with the upstream-directed component U (FIGS. 4 and 5) of flow from the curtain promoting removal of coolant water from the adjacent upstream curtain while the downstream component D (resulting from strip movement) on the strip surface flows unimpeded through the space to the next downstream curtain.

Control and containment of coolant are also facilitated by the use of low pressure curtains, as compared to high-pressure jets. There is relatively little lateral flow component, enabling beneficial confinement of coolant below the strip by adjustment of the shutters 46 occluding the end portions of the slots. The shutters, together with the side plates 48, effectively prevent the coolant water of the curtains from coming into contact with the upwardly-facing strip surface. Since the upstream projection of the low-velocity curtains is well defined and very limited, the length of strip subjected to cooling (and hence the extent of cooling) in a particular interstand locality can be satisfactorily adjusted by progressively shutting off the flow through the slots 32 (with valves 38) starting from the upstream end of the array of slots in that cooling locality. Relatively fine control is thereby attainable, because each curtain covers only a short length of the cooling locality.

Coolant water flow rate must be sufficient so that the temperature rise in the coolant water remains within manageable limits, yet not so excessive as to cause handling problems or swamp the system. If the temperature rise (which is inversely proportional to the flow rate) is too great, it will adversely reduce the strip/coolant temperature difference and thereby increase the heat transfer coefficient required to achieve a desired temperature reduction. The preferred or illustrative slot dimensions and pressure values given above afford suitable conditions for effective interstand cooling without imposing inconveniently close manufacturing tolerances.

In the present process, in its described embodiments as applied to interstand strip cooling in a cold rolling mill, the coolant water may contain minor amounts of lubricant (rolling oil). Although such oil, in large proportions, adversely affects heat transfer, it has been found in tests that amounts up to at least about 10% (the levels likely to be encountered in the contemplated cold rolling operations) are inconsequential; i.e., even when the coolant water contains up to 10% oil, the heat transfer coefficients of the low-pressure water curtains employed in the invention are much more than adequate for the desired cooling.

Much of the coolant water delivered to the downwardly facing strip surface by the array of slots at each cooling locality is removed simply by falling away from the surface, without acquiring any substantial downstream velocity from the strip. To minimize the pressure head required to maintain constant flow of the water curtains, the manifolds 30 should be spaced apart sufficiently so that the water thus falling from the strip does not flood the manifolds and impede the water curtains. Also, the manifold faces are desirably so shaped that water falling onto the manifolds drains away without interfering with the discharge of water through slots 32.

Figure 12:
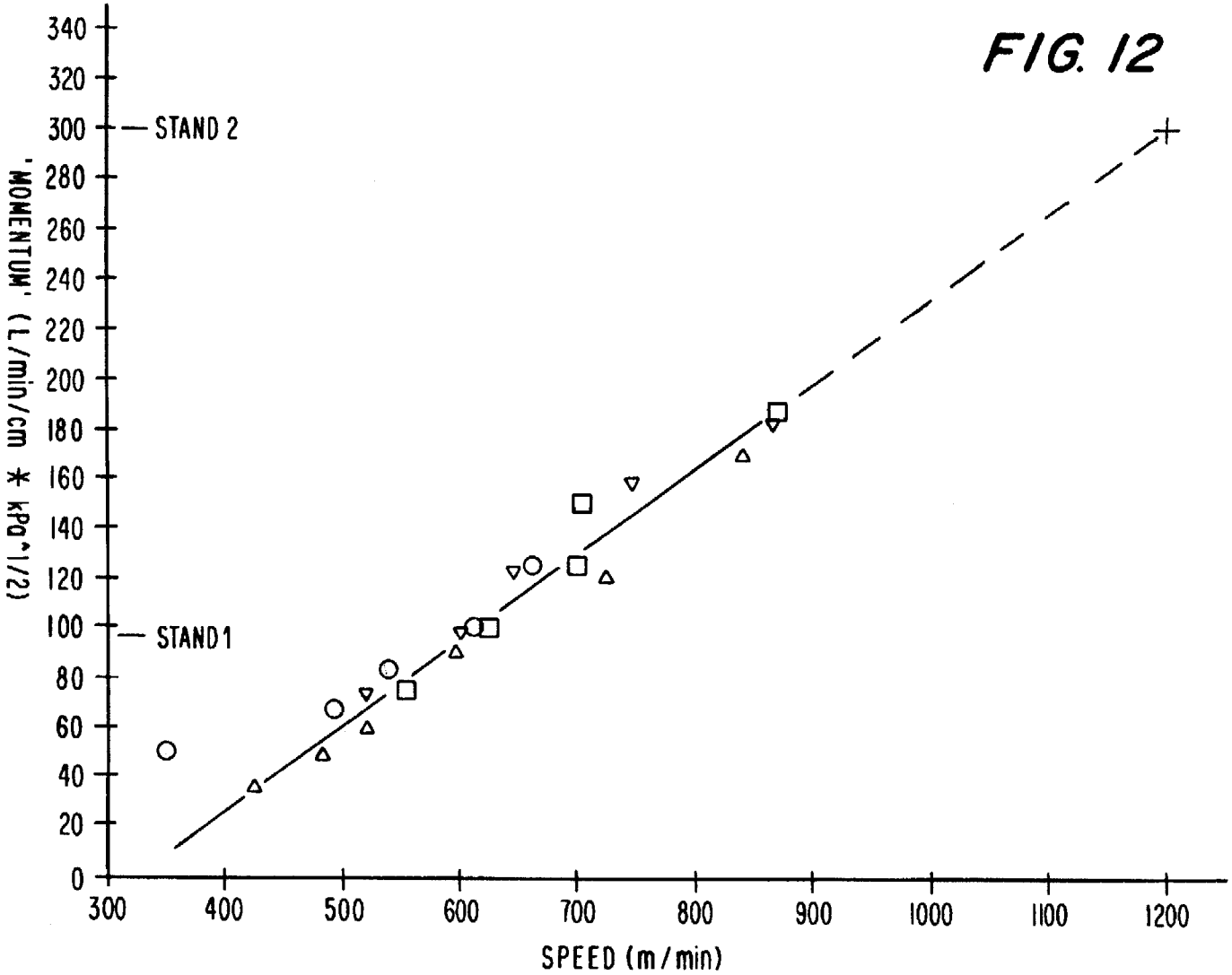
FIG. 12 is a graph relating water knife pressure and flow to strip speed.

Flying water, dropping from the wetted strip surface with a substantial component of forward velocity imparted by the moving strip, is largely intercepted by the barrier 50. Downstream passage of such flying water through and beyond the gap between the barrier and the strip is prevented by the water knife **52*a* of FIG. 9 or the oil knife 60*a* of FIG. 10. The water knife directs high pressure sprays of water against the strip, along a line of impingement at which the strip is backed up by the hold-down roll, to provide a curtain of water that intercepts the oncoming flying water with sufficient momentum to stop its flow. The requisite counter momentum for the water knife is provided by selection of pressure and flow conditions. FIG. 12** shows values of pressure and flow conditions, determined under experimental conditions simulating coolant removal operation with a water knife on a cold-rolling line, providing counter momentum effective to arrest downstream advance of flying water, for various different strip speeds, nozzles and stand-offs.

The water knife **52*a* also removes some of the residual coolant water that is carried on the downwardly facing strip surface beyond the array of water curtains 44. Further in accordance with the process of the invention, this residual water layer on the strip is removed or reduced sufficiently to prevent interference with downstream operations or staining of the strip in the rewind coil. Such removal can be effected by an air knife (not shown) acting against the strip (at a point where the strip is still backed up by the hold-down roll) downstream of the line of impingement of the water knife 52*a***. For example, with a nozzle slot 0.7 mm wide at a stand-off of 1.5 mm and at a pressure of 100 kPa(g), an air knife can reduce the residual water film on the strip to a satisfactorily low average thickness of 0.25 micron; however, the stand-off required by an air knife is much smaller than is usually acceptable in cold rolling mills, and presents substantial problems of noise and handling of water-laden air.

As a particular feature of the present process, therefore, the residual water film carried away from the water curtains on the downwardly facing strip surface is very preferably reduced by the action of the oil knife **54*a* (FIG. 9) or 60*a* (FIG. 10**), rather than by an air knife. Some oil from the knife remains on the strip surface, but this is unobjectionable since the oil does not stain the metal. Also, the residual liquid film on the surface downstream of the oil knife is considerably thicker than that remaining after the air knife treatment described above; but is found that much of this film is oil, and that the effective thickness (assuming separate, homogeneous oil and water layers in the film) of the residual water component of the film after the oil knife treatment can be as little as 0.4 micron.

By way of further and more specific illustration of the invention, reference may be made to the following hypothetical examples:

EXAMPLE 1

In a hypothetical but exemplary cold-rolling operation in a mill as shown in FIG. 1, rolling conditions and desired interstand cooling are as follows:

Aluminum strip from the pay-off coil 18 enters the first roll stand **11*a* at an initial gauge of 2.4 mm and an initial strip velocity of 225 m/min., leaves roll stand 11*a* at a first intermediate gauge of 1.2 mm and a strip velocity of 450 m/min., leaves the second roll stand 11*b* at a second intermediate gauge of 0.6 mm and a strip velocity of 900 m/min., and leaves the third roll stand 11*c*** at a final cold-rolled gauge of 0.3 mm and an exit strip velocity of 1800 m/min. for rewinding. In each roll stand, in this example, the strip thickness is reduced by 50% and the strip velocity is correspondingly increased by 50%, such that the mass flow (mass of metal per unit time) entering each roll stand is the same as the mass flow exiting the same roll stand.

The strip, entering the first roll stand 11*a* at an initial temperature of 30° C., is there increased in temperature by 120° C., thus leaving roll stand 11*a* at a temperature of 150° C. In a first interstand cooling locality 26 (between roll stands 11*a* and 11*b*) the strip is desirably reduced in temperature by 80° C., i.e. to 70° C., at which temperature it enters the second roll stand 11*b*. The strip temperature increases by 100° C. (to 170° C.) in roll stand 11*b*; thereafter, in a second interstand cooling locality 28 (between roll stands 11*b* and 11*c*) the strip temperature is desirably reduced by 100° C., so that the strip entering the final roll stand 11*c* is again at a temperature of 70° C. An 80° C. increase in strip temperature in roll stand 11*c* brings the strip to a final (mill exit) temperature of 150° C., which is a suitable rewind temperature.

In the described process of the invention, cooling of the strip is governed by the general relationship:

$$\Phi=HTC\times(T_s-T_o)$$

where $\Phi$ is heat flux, HTC is heat transfer coefficient, $T_s$ is strip temperature, and $T_o$ is coolant liquid temperature. In an interstand cooling locality (26 or 28, in the above-described mill), the heat H removed per $m^2$ of strip ($KJ/m^2$) is given by $$H=(t/1000)\times D\times S\times(T_1-T_2)$$

where t is strip gauge (mm), D is the strip material density ($kg/m^3$), S is specific heat (kJ/kg °C.), $T_1$ is the strip temperature (°C.) entering the cooling zone, and $T_2$ is the strip temperature (°C.) leaving the cooling zone. As will be understood, $(T_1-T_2)$ represents the desired temperature reduction to be achieved in the cooling zone, and $(T_1+T_2)/2$ is the average value of $T_s$ in the cooling zone. The time W (sec.) available for cooling in the cooling zone is given by W=L/V, where L is the length of the cooling zone (m), a factor determined by the space available for coolant between successive roll stands, and V is the strip velocity (m/sec.) through that interstand locality. Thus the heat flux ($kJ/m^2$ sec.) for the defined conditions, to achieve the specified temperature reduction, is $$\Phi=(D\times S/1000)\times(t\times V/L)\times(T_1-T_2)$$

and, since the average temperature differential is $[(T_1+T_2)/2-T_o]$ in °C., the average heat transfer coefficient ($kW/m^{2\circ}C.$) required for the desired cooling is $$HTC_A=[2(D\times S/1000)\times t\times V\times(T_1-T_2)]/[L\times(T_1+T_2-2T_o)]$$

Applying the foregoing considerations to the specific numerical values set forth in the illustrative hypothetical example of mill operation described above, and assuming that L (available length for cooling) in each interstand locality is one meter, that the coolant employed is at a temperature $T_o$=30° C., and that the strip material has a density D=2700 $kg/m^3$ and a specific heat S=0.96 kJ/kg °C. (these values being exemplary of aluminum strip), the required average heat transfer coefficient $HTC_A$ for achieving the desired temperature reduction by application of coolant to only one major surface of the strip is 23.4 $kW/m^{2\circ}$ C. in interstand locality 26 and 26.0 $kW/m^{2\circ}$ C. in interstand locality 28. The variation in $HTC_A$ between the two interstand localities is determined only by the differences in temperatures involved, because the gauge and strip velocity are linked by a constant mass flow.

FIG. 11 illustrates experimentally determined values of heat transfer coefficient for various strip velocities, as determined in an experiment simulating cooling of aluminum strip in accordance with the invention, using water curtains spaced 150 mm apart on centers, inclined 22.5° to the vertical against the direction of strip motion with water at 15 kPa gauge and at a temperature of 20° C., and strip 0.3 mm thick. The graph shows that heat transfer coefficients well in excess of those required for the desired cooling in the interstand localities 26 and 28, as calculated for the hypothetical example of mill operation described above, were achieved, and that the heat transfer coefficient increases with increasing strip velocity.

EXAMPLE 2

Following are specifications for a cooling/coolant removal system for use with a three-stand tandem cold rolling mill as shown at 10 in FIG. 1, for rolling the aluminum alloy identified by Aluminum Association registration number 5182 (as to which the upper limit of exit or rewind temperature is 135° C.), assuming that in the first interstand locality 26 the maximum strip gauge is 1.2 mm, the maximum strip speed is 610 m/min., and the strip is to be cooled from 160° to 70° C., and in the second interstand locality 28 the maximum strip gauge is 0.6 mm, the maximum strip speed is 1220 m/min., and the strip is to be cooled from 170° to 70° C.; and further assuming that the space available for cooling in each interstand locality (between the upstream roll stand 11*a* or 11*b* and the hold-down roll 56) is 1.4 m long and up to 2.1 m wide; and that the minimum clearance of cooling system elements from the strip is 50 mm where the strip is unsupported, or 12 mm where the strip is in contact with a roll such as the hold-down roll.

Coolant: water with residual oil not exceeding 5% by volume; maximum flow per interstand space 4550 L/min; maximum incoming temperature 40° C.

Coolant application: 1.0 mm wide symmetrical slots 32 with convergent entry, spaced 100 to 150 mm apart along strip path, oriented to direct water curtains at an angle of 20° to 25° from vertical against strip motion; coolant flow 1.5 to 2.5 L/min. per cm of slot length; minimum drainage area of 1 $cm^2$ per cm of slot length.

Coolant removal: liquid knife comprising an array of 15° "Flatjet" nozzles (commercially available from Spraying Systems) with size and spacing such that the flow in L/min per cm of strip width times the square root of supply pressure (k Pa gauge) is equal to 97 in interstand locality 26 and equal to 300 in interstand locality 28; nozzles arranged so that there is no mutual interference of jets before impingement; line of impingement at the end of the wrap angle on the hold-down roll; angle of knife impingement on strip 30°–35° to the tangent to the strip at the line of impingement, with knife directed counter to direction of strip motion; clearance of liquid knife nozzles 2.5 to 5 cm from strip.

It is to be understood that the invention is not limited to the features and embodiments hereinabove specifically set forth, but may be carried out in other ways without departure from its spirit.

What is claimed is:

1. In cold rolling procedure wherein aluminum strip is advanced continuously longitudinally along a generally horizontal path with opposed major surfaces of the strip respectively facing upwardly and downwardly, through at least one roll stand for reducing the thickness of the strip by cold rolling, a process for cooling the strip from an initial temperature of up to 300° C., while advancing the strip at a velocity of at least 225 m/min., comprising the steps of:

(a) delivering coolant liquid into contact with only the downwardly facing surface of the advancing strip by discharging the coolant liquid upwardly, onto the downwardly facing strip surface, through a plurality of upwardly opening slots disposed below the strip in spaced relation thereto, the slots being spaced apart along the path and each extending, transversely of the path, across substantially the entire width of the strip, at a location downstream of said one roll stand in the direction of strip advance, while (b) preventing the discharged coolant liquid from coming into contact with the upwardly facing surface of the strip, and, (c) downstream of the plurality of slots in the direction of strip advance, removing coolant liquid from the downwardly facing strip surface.

2. A process according to claim 1, wherein the coolant liquid comprises water.

3. A process according to claim 1, wherein all the slots are oriented to direct the coolant liquid toward the strip at an angle of at least 90° to the direction of advance of the strip in the path.

4. A process according to claim 1, wherein the removing step comprises directing a fluid knife against the downwardly facing strip surface, at an angle greater than 90° to the direction of strip advance, downstream of the plurality of slots.

5. A process according to claim 1, wherein said procedure is a multistand cold rolling procedure in which the metal strip is advanced continuously longitudinally through at least two roll stands in succession for progressively reducing the thickness of the strip, the roll stands being spaced apart in tandem along the generally horizontal path, and wherein the cooling, preventing, and removing steps are performed at a cooling locality disposed between said two roll stands in said path.

6. A process according to claim 1, wherein the metal strip is advanced continuously longitudinally through at least three roll stands in succession for progressively reducing the thickness of the strip, the roll stands being spaced apart in tandem along the generally horizontal path, and wherein the cooling, preventing, and removing steps are performed repetitively at each of at least two cooling localities respectively disposed between successive roll stands in said path.

7. A process according to claim 1, wherein the coolant liquid comprises water containing not more than about 5% by volume oil.

8. A process according to claim 1, wherein the removing step comprises training the strip around a hold-down roll in contact with the upwardly facing strip surface, downstream of the plurality of slots, and engaging the downwardly facing strip surface with a guide roll, for exerting a squeegee action thereon, at a location downstream of the hold-down roll.

9. A process according to claim 1, wherein said procedure is a cold rolling procedure in which the metal strip is advanced continuously longitudinally from a pay-off stand through at least one roll stand for reducing the thickness of the strip, and wherein the cooling, preventing, and removing steps are performed at a cooling locality disposed between said pay-off stand and said one roll stand in said path.

10. A process according to claim 3, wherein at least all but the furthest upstream of the slots are oriented to direct the coolant liquid toward the strip at an angle greater than 90° to the direction of advance of the strip in the path.

11. A process according to claim 3, wherein that one or more of the slots which are furthest upstream with respect to the strip path is oriented to direct the coolant liquid toward the strip at an angle of about 90° to the direction of strip advance, for limiting the upstream extent of coolant delivery.

12. A process according to claim 3, wherein the coolant liquid comprises water and is supplied to the slots at a pressure such that it impinges on the strip from each slot as a continuous curtain of water across substantially the full width of the strip without substantially upwardly deflecting the strip.

13. A process according to claim 3, wherein the slots are each between 0.2 and 5.0 mm wide.

14. A process according to claim 3, wherein the slots are each between about 0.5 and about 2.0 mm wide.

15. A process according to claim 3, wherein the spacing between adjacent slots, in the direction of strip advance, is between about 50 and about 500 mm.

16. A process according to claim 3, wherein the spacing between adjacent slots, in the direction of strip advance, is between about 100 and 150 mm.

17. A process according to claim 12, wherein the step of supplying the slots with coolant liquid comprises supplying all the slots with liquid coolant from a constant head standpipe.

18. A process according to claim 12, wherein the step of preventing the discharged coolant from coming into contact with the upwardly facing strip surface comprises occluding end portions of the slots to substantially prevent the curtains of water from extending beyond opposed side edges of the strip.

19. A process according to claim 12, wherein the step of preventing the discharged coolant from coming into contact with the upwardly facing strip surface comprises confining a region containing said curtains below said strip path to hinder escape of coolant liquid from said region.

20. A process according to claim 17, wherein all the slots are supplied with liquid coolant comprising water from the standpipe at a head of less than 10 m.

21. A process according to claim 17, including the step of controlling the extent of cooling of the strip by individually turning off discharge of coolant liquid from at least an upstream one of the slots while permitting discharge of liquid through at least a downstream one of the slots.

22. A process according to claim 20, wherein the head is less than about 3 m.

23. A process according to claim 22, wherein the head is less than 1 m.

24. A process according to claim 4, wherein said fluid knife is a liquid knife.

25. A process according to claim 4, wherein the removing step further includes maintaining a stationary barrier below the path downstream of the plurality of slots to intercept liquid coolant flying from the downwardly facing strip surface with a substantial horizontal component of velocity.

26. A process according to claim 24, wherein said liquid knife is a knife of the same liquid as said coolant liquid.

27. A process according to claim 24, wherein said liquid knife is a knife of a liquid different from and immiscible with said coolant liquid.

28. A process according to claim 24, wherein the removing step further includes training the strip around a hold-down roll in contact with the upwardly facing strip surface at a location such that the liquid knife impinges against the downwardly facing strip surface at a point at which the upwardly facing strip surface engages said hold-down roll.

29. A process according to claim 26, wherein the removing step further includes directing a second liquid knife against the downwardly facing strip surface downstream of the first-mentioned liquid knife, and wherein the second liquid knife is a knife of a liquid different from and immiscible with said coolant liquid.

30. A process according to claim 27, wherein the coolant liquid is water and the knife liquid is oil.

31. A process according to claim 29, wherein the coolant liquid comprise water and the second-knife liquid is oil.

32. A process according to claim 28, wherein the removing step further includes directing a second liquid knife against the downwardly facing strip surface at a point, downstream of the first-mentioned liquid knife, at which the upwardly facing strip surface engages said hold-down roll, the first-mentioned liquid knife being a knife of the same liquid as the coolant liquid, and the second liquid knife being a knife of a liquid different from and immiscible with said coolant liquid.

33. A process according to claim 28, wherein the removing step further includes training the strip around a guide roll in contact with the downwardly facing strip surface at a location downstream of the hold-down roll.

34. A process according to claim 5, wherein said coolant comprises water, and wherein at least all but the furthest upstream of the slots are oriented to direct the coolant liquid toward the strip at an angle greater than 90° to the direction of advance of the strip in the path.

35. A process according to claim 5, wherein said coolant liquid comprises water.

36. A process according to claim 9, wherein said coolant liquid comprises water.

37. In procedure wherein metal strip is advanced continuously longitudinally along a generally horizontal path with opposed major surfaces of the strip respectively facing upwardly and downwardly, while coolant liquid is applied to the downwardly facing surface of the strip at a cooling locality, a process for removing coolant liquid from the downwardly facing strip surface downstream of the cooling locality, comprising (a) directing a liquid knife against the downwardly facing strip surface, at an angle greater than 90° to the direction of strip advance, downstream of the cooling locality, while (b) training the strip around a hold-down roll in contact with the upwardly facing strip surface at a location such that the fluid knife impinges against the downwardly facing strip surface at a point at which the upwardly facing strip surface engages said hold-down roll.

38. A process according to claim 37, wherein the liquid knife is a knife of a liquid different from and immiscible with said coolant liquid.

39. A process according to claim 37, further including the step of directing a second liquid knife against the downwardly facing strip surface at a point, downstream of the first-mentioned liquid knife in the direction of strip advance, at which the upwardly facing strip surface engages said hold-down roll, the first-mentioned liquid knife being a knife of the same liquid as said coolant liquid, and the second liquid knife being a knife of a liquid different from and immiscible with said coolant liquid.

40. In multistand cold rolling procedure wherein aluminum strip is advanced continuously longitudinally in succession through at least two roll stands for progressively reducing the thickness of the strip, the roll stands being spaced apart in tandem along a generally horizontal path in which the strip advances with opposed major surfaces of the strip respectively facing upwardly and downwardly, a process for cooling the strip from an initial temperature of up to 300° C. as it advances between said two roll stands, while advancing the strip at a velocity of at least 225 m/min., said process comprising, at a cooling locality disposed between said two roll stands in said path, (a) delivering coolant liquid comprising water into contact with only the downwardly facing surface of the advancing strip by discharging said coolant liquid upwardly, onto said downwardly facing strip surface, through a plurality of upwardly opening slots disposed below the strip in spaced relation thereto, said slots being spaced apart along said path and each extending, transversely of the path, across substantially the entire width of the strip, said coolant liquid being supplied to said slots at a pressure such that the coolant liquid impinges on the strip without substantially upwardly deflecting the strip, while (b) preventing the discharged coolant liquid from coming into contact with the upwardly facing surface of the strip, and (c) between said plurality of slots and the downstream one of said roll stands in the direction of strip advance, removing coolant liquid from the downwardly facing strip surface.

41. In a multistand line for cold-rolling aluminum strip including at least two roll stands spaced apart in succession along a generally horizontal path in which the strip advances with opposed major surfaces of the strip respectively facing upwardly and downwardly, and means for advancing the metal strip continuously and successively along said path at a velocity of at least 225 m/min. through said two roll stands for progressively reducing the thickness of the strip, apparatus for cooling the strip from an initial temperature of up to 300° C. as it advances between said two roll stands, said apparatus comprising, at a cooling locality disposed between said two roll stands in said path, (a) means for delivering coolant liquid into contact with only the downwardly facing surface of the advancing strip by discharging said coolant liquid upwardly, onto said downwardly facing strip surface, through a plurality of upwardly opening slots disposed below the strip in spaced relation thereto, said slots being spaced apart along said path and each extending, transversely of the path, across substantially the entire width of the strip;

(b) means for supplying said coolant liquid to said slots at a pressure such that the coolant liquid impinges on the strip without substantially upwardly deflecting the strip;

(c) means for preventing the discharged coolant liquid from coming into contact with the upwardly facing surface of the strip, and (d) means for removing coolant liquid from the downwardly facing strip surface between said plurality of slots and the downstream one of said roll stands in the direction of strip advance.

42. Apparatus as defined in claim 41, wherein said multistand cold rolling line includes at least three roll stands spaced apart along said path, and through which the metal strip is continuously and successively advanced for progressively reducing the thickness of the strip, and wherein at each of plural cooling localities respectively disposed between successive roll stands in said path there are provided separate delivering means, removing means and preventing means as aforesaid.

43. Apparatus as defined in claim 41, wherein said removing means comprises means for directing a liquid knife against the downwardly facing strip surface, at an angle greater than 90° to the direction of strip advance, downstream of the cooling locality; and a hold-down roll around which the strip is trained in contact with the upwardly facing strip surface at a location such that the fluid knife impinges against the downwardly facing strip surface at a point at which the upwardly facing strip surface engages said hold-down roll.

44. Apparatus as defined in claim 42, wherein said supplying means comprises a common constant head standpipe from which the coolant liquid flows to the delivering means at all of said plural cooling localities.

45. Apparatus as defined in claim 43, further including means for directing a second liquid knife against the downwardly facing strip surface at a point, downstream of the first-mentioned liquid knife in the direction of strip advance, at which the upwardly facing strip surface engages said hold-down roll, the second liquid knife being a knife of a liquid different from that of the first-mentioned knife.

46. For use in a system wherein metal strip is advanced continuously along a generally horizontal path with opposed major surfaces of the strip respectively facing upwardly and downwardly, while coolant liquid is applied to the downwardly facing surface of the strip at a cooling locality, apparatus for removing coolant liquid from the downwardly facing strip surface downstream of the cooling locality, comprising (a) means for directing a liquid knife against the downwardly facing strip surface, at an angle greater than 90° to the direction of strip advance, downstream of the cooling locality; and (b) a hold-down roll around which the strip is trained in contact with the upwardly facing strip surface at a location such that the fluid knife impinges against the downwardly facing strip surface at a point at which the upwardly facing strip surface engages said hold-down roll.

47. In cold rolling procedure wherein aluminum strip is advanced continuously longitudinally along a generally horizontal path with opposed major surfaces of the strip respectively facing upwardly and downwardly, through at least one roll stand for reducing the thickness of the strip by cold rolling, a process for controlling the temperature of the strip by cooling from an initial temperature of up to 300½° C., while advancing the strip at a velocity of at least 225 m/min., comprising the steps of:

(a) delivering coolant liquid into contact with only the downwardly facing surface of the advancing strip by discharging the coolant liquid upwardly, onto the downwardly facing strip surface, through a plurality of upwardly opening slots disposed below the strip in spaced relation thereto, the slots being spaced apart along the path and each extending, transversely of the path, across substantially the entire width of the strip, at a location downstream of said one roll stand in the direction of strip advance, while (b) preventing the discharged coolant liquid from coming into contact with the upwardly facing surface of the strip, and, (c) downstream of the plurality of slots in the direction of strip advance, removing coolant liquid from the downwardly facing strip surface, and (d) controlling the discharge of coolant liquid through said slots for providing said strip, at a predetermined point in said path downstream of the plurality of slots, at a temperature substantially equal to a predetermined target temperature.

48. A process according to claim 47, wherein the discharge-controlling step comprises individually turning off discharge of coolant liquid from at least an upstream one of the slots while permitting discharge of liquid through at least a downstream one of the slots.

49. A process according to claim 47, further including the step of sensing the temperature of the strip at least at one predetermined point in said path, and wherein the discharge-controlling step comprises controlling the discharge of water through said slots in response to the sensed strip temperature at said last-mentioned point.

50. A process according to claim 47, wherein the discharge-controlling step comprises controlling the discharge of water through said slots in accordance with a predetermined cooling schedule for the strip advancing along the path.

51. In a line for cold-rolling aluminum strip including a pay-off stand and at least one roll stand spaced apart in succession along a generally horizontal path in which the strip advances with opposed major surfaces of the strip respectively facing upwardly and downwardly, and means for advancing the metal strip continuously and successively at a velocity of at least 225 m/min. along said path from said pay-off stand through said one roll stand for reducing the thickness of the strip, apparatus for cooling the strip from an initial temperature of up to 300° C. as it advances from said pay-off stand to said one roll stand, said apparatus comprising, at a cooling locality disposed between said pay-off stand and said one roll stand in said path, (a) means for delivering coolant liquid into contact with only the downwardly facing surface of the advancing strip by discharging said coolant liquid upwardly, onto said downwardly facing strip surface, through a plurality of upwardly opening slots disposed below the strip in spaced relation thereto, said slots being spaced apart along said path and each extending, transversely of the path, across substantially the entire width of the strip;

(b) means for supplying said coolant liquid to said slots at a pressure such that the coolant liquid impinges on the strip without substantially upwardly deflecting the strip;

(c) means for preventing the discharged coolant liquid from coming into contact with the upwardly facing surface of the strip, and (d) means for removing coolant liquid from the downwardly facing strip surface between said plurality of slots and said one roll stand in the direction of strip advance.

* * * * *